US010808344B2

(12) United States Patent
Rosenbach

(10) Patent No.: US 10,808,344 B2
(45) Date of Patent: Oct. 20, 2020

(54) TURNED EDGE FABRIC CIRCLE APPLIQUES

(71) Applicant: Ellen Rosenbach, North Palm Beach, FL (US)

(72) Inventor: Ellen Rosenbach, North Palm Beach, FL (US)

(73) Assignee: ELLEN'S QUILTS II, LLC, North Palm Beach, FL (US)

( * ) Notice: Subject to any disclaimer, the term of this patent is extended or adjusted under 35 U.S.C. 154(b) by 0 days.

(21) Appl. No.: 16/738,838

(22) Filed: Jan. 9, 2020

(65) Prior Publication Data

US 2020/0216992 A1 Jul. 9, 2020

Related U.S. Application Data

(60) Provisional application No. 62/790,275, filed on Jan. 9, 2019.

(51) Int. Cl.
*D05C 1/04* (2006.01)
*D05B 97/02* (2006.01)

(52) U.S. Cl.
CPC ..... *D05C 1/04* (2013.01); *D05B 97/02* (2013.01)

(58) Field of Classification Search
CPC ... D05C 1/00; D05C 1/02; D05C 1/04; D05C 9/04; D05C 9/10; D05B 97/02; D05B 97/00; D05B 97/12; D05B 11/00; G01B 3/14; G09B 19/20; A41H 1/00; A41H 3/00
See application file for complete search history.

(56) References Cited

U.S. PATENT DOCUMENTS 1,062,525 A * 5/1913 Ward ..... G01B 3/34 33/555.2
2,666,935 A * 1/1954 Gilbert ..... A43D 11/12 12/64
4,230,164 A * 10/1980 Mericle ..... B23Q 35/42 144/144.1
5,065,523 A * 11/1991 Chiang ..... B43L 11/043 33/562

(Continued)

FOREIGN PATENT DOCUMENTS

GB 2107368 A * 4/1983

*Primary Examiner* — Ismael Izaguirre
(74) *Attorney, Agent, or Firm* — Ansari Katiraei LLP; Arman Katiraei; Sadiq Ansari

(57) ABSTRACT

Turned edge fabric appliqués are produced using a first template whose perimeter corresponds to a desired shape of a finished appliqué of certain size, and a second template having a corresponding opening so that the perimeter of the first template fits in the opening with a determined gap between the templates. The perimeter of the second template corresponds to an appliqué of the desired shape but a size larger than said certain size, and the second template fits in a corresponding opening in a third template to obtain the appliqué of larger size. A fabric piece is placed by the first template into the opening in the second template, and an exposed edge of the piece projects through the gap above the first template to define a seam allowance which is ironed atop the first template. The template is then withdrawn from the opening and from the ironed seam allowance.

17 Claims, 4 Drawing Sheets

(56) References Cited

U.S. PATENT DOCUMENTS

| | | | | |
|---|---|---|---|---|
| 5,141,140 | A * | 8/1992 | Moffett-Hall | A41H 33/00 223/1 |
| 5,531,176 | A * | 7/1996 | Johnson | D05B 97/12 112/439 |
| 6,286,224 | B1 * | 9/2001 | Lewis | G01B 3/14 33/512 |
| 6,443,081 | B1 * | 9/2002 | Quint | D05B 97/12 112/439 |
| 6,446,571 | B1 * | 9/2002 | Sloot | B60Q 7/005 116/209 |
| 8,074,384 | B2 * | 12/2011 | Kuwabara | D05C 1/02 38/102.2 |
| 8,393,093 | B2 * | 3/2013 | Cleveland | B65H 45/12 33/11 |
| 2014/0315158 | A1 * | 10/2014 | Wischusen, III | B43L 13/007 434/81 |

* cited by examiner

TURNED EDGE FABRIC CIRCLE APPLIQUES

CROSS REFERENCE TO RELATED APPLICATION

This application claims priority under 35 U.S.C. § 119(e) of U.S. Provisional Patent Application No. 62/790,275 filed Jan. 9, 2019, titled Fabric Circle Appliqués, the entire contents of which are incorporated by reference.

BACKGROUND OF THE INVENTION

Field of the Invention

The present invention relates generally to quilting, and particularly to a technique and kit for making perfect turned edge fabric circle and other shape appliqués for quilts.

Discussion of the Known Art

Many publications, articles, and websites are known which address the problem of producing ready-to-appliqué circles for quilts from fabric pieces. See, for example, www.connectingthreads.com/karen-kay-buckley-s-perfect-circles/p/81770, and U.S. Pat. No. 5,531,176 (Jul. 2, 1996).

Moreover, there have been many attempts to improve accuracy of cutting pieces of fabric to make quilts. For example, U.S. Pat. No. 4,779,346 which discloses a template of a rectangular transparent sheet marked with a rectangular grid of lines and oblique lines to assist in sewing, quilting etc. to achieve a selected pattern; U.S. Pat. No. 4,608,939 which discloses a template for hand sewing to ensure equal spacing of stitches; and U.S. Pat. No. 4,945,642 which describes a quilting template for guiding a cutting tool to assist in quilting operations.

Popular methods of making circle appliqués include (1) needle turn appliqué, (2) circular freezer paper templates with starch, (3) templates with glue, (4) making running stitches along an edge of the fabric piece, gathering up the stitches encasing the edges of the piece about a circular template, starching and pressing the fabric on the template, and removing the template, (5) fusing wherein the fabric piece is cut to the exact size of the desired circle with no seam allowance. The cut piece is fused to stabilize the appliqué and help minimize raveling. It is then attached by machine or hand using the desired stitch. The process makes the appliqué stiff causing unfavorable reviews, and (6) English paper piecing which is only suitable for hand sewing, wherein the quilter hand bastes fabric around a desired paper shape and whipstitches it next to a matching desired shape. The finished larger shape is then attached to the quilt. The paper must be removed from the back of the appliqué by cutting through the background fabric which is not only time consuming and tedious, but also weakens the final quilt.

U.S. Pat. No. 5,141,140 (Aug. 25, 1992) discloses apparatus for preparing a quilt appliqué including a template in the shape of a desired appliqué, and a rectangular shape plate having an opening of the same shape as that of the template. See also U.S. Pat. No. 5,791,062 (Aug. 11, 1998) which discloses a flat sheet template that facilitates making conventional quilting units, and U.S. Pat. No. 7,814,832 (Oct. 19, 2010) which relates to a method of preparing fabric for cutting and/or sewing.

Notwithstanding the known art, there is a need for a technique and a kit for producing fabric appliqués in multiple sizes, wherein the kit is easy to use, portable, long lasting, and of an elegant configuration requiring no prethought or preparation on the part of the user. There is also a need for a kit for making turned edge circle appliqués whose diameters range from as small as ⅜ inch to two inches or more.

SUMMARY OF THE INVENTION

According to the invention, a method of making a fabric appliqué includes providing a first template the perimeter of which is dimensioned and formed to correspond to a desired shape of a finished appliqué of a certain size, and providing a second template having an opening dimensioned and formed so that the perimeter of the first template fits within the opening in the second template with a determined gap between the first and the second templates. The second template has a perimeter dimensioned and formed to correspond to the desired shape but of a size larger than said certain size, and the second template fits within a corresponding opening in a third template to obtain an appliqué of the larger size.

A fabric piece is cut so as to leave an exposed edge beyond the perimeter of the first template when placed between the first template and the opening in the second template, and the first template places the piece into the opening so that the exposed edge of the piece projects above the template through the gap between the first and the second templates to define a seam allowance. The seam allowance is ironed flat atop the first template, the first template is removed with the fabric piece from the opening in the second template, and the first template is withdrawn from the ironed seam allowance to obtain the finished appliqué.

According to another aspect of the invention, a kit for making fabric appliqués in multiple sizes, includes at least a first, a second, and a third template. The first template is dimensioned and formed to fit in a central opening in the second template with such clearance as to form a determined gap between the first and the second templates through which a seam allowance of a first fabric piece can pass. The second template is dimensioned and formed to fit in a central opening in the third template with enough clearance to form a determined gap between the second and the third template through which a seam allowance of a second fabric piece can pass.

The perimeter of the first template corresponds to a desired shape of a finished appliqué of a certain size, and the perimeter of the second template corresponds to a finished appliqué having the desired shape but of a size larger than said certain size, wherein the second template fits in the central opening in the third template to obtain the appliqué of larger size.

The gap between the first and the second templates is dimensioned so that when (i) a fabric piece of a size that extends beyond the central opening in the second template to define a seam allowance is placed between the first and the second templates, and (ii) the first template places the fabric piece into the central opening in the second template, the seam allowance projects through the gap and above the first template to be ironed flat atop the template, and the first template is removable from the opening so that the template can be withdrawn from the ironed seam allowance to obtain the finished appliqué.

If the templates are in the form of flat rings or washers as in the illustrated embodiment, then the outside diameters of the templates may be selected from among, e.g., ⅜ in., ½ in., ⅝ in., ¾ in., ⅞ in., 1 in., 1¼ in., and up to 2.25 in. Note that the smallest (or the first) template in the kit does not require a central opening.

For a better understanding of the invention, reference is made to the following description taken in conjunction with the accompanying drawing and the appended claims.

BRIEF DESCRIPTION OF THE DRAWING FIGURES

DETAILED DESCRIPTION OF THE INVENTION

The present invention enables finished fabric appliqués of a desired shape to be produced in one or more sizes using the following items:

Scissors;

Quilting weight fabric;

Iron;

Liquid Starch or Sizing

Small Paintbrush or Dauber

A kit of appliqué templates as described herein.

Figure 1:
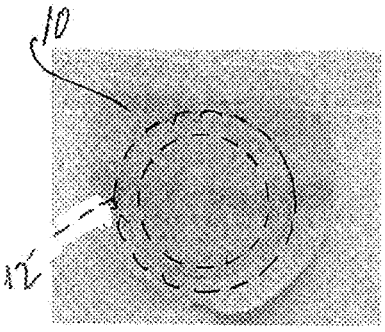
FIG. 1 shows a rough cut fabric piece placed over a second template having a central circular opening.
Figure 2:
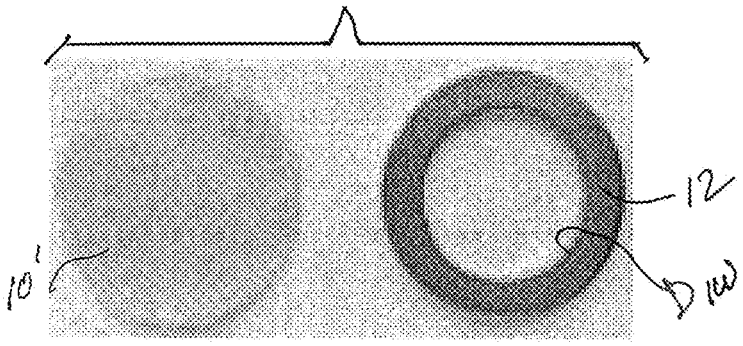
FIGS. 2 and 3 show the fabric piece when trimmed to form a circle the diameter of which extends beyond the opening in the second template to form a seam allowance.

FIG. 1 shows a rough cut fabric piece 10 of, e.g., 100% quilting cotton, and FIG. 2 shows a second template 12 which, in the present embodiment, is in the form of a circular flat washer or ring having a central opening O whose inside diameter $O_{ID}$ corresponds to the outside diameter of a desired fabric circle appliqué. The overall area of the fabric piece 10 should be sufficient to cover the central opening O in the second template 12, and extend beyond the opening O to define a seam allowance. That is, when placed over the second template 12, the fabric piece 10 is preferably trimmed near the outer circumference of the template to form a circular fabric piece 10' shown in FIG. 2. The fabric piece 10' may then be painted with a liquid starch using a paint brush or dauber.

Alternatively, instead of trimming the rough cut fabric piece 10 near the outer circumference of the second template 12, the piece 10 can be trimmed to form the circular piece 10' after a central portion of the rough cut piece 10 is placed in the opening O in the template 12 by a first template 14, as described below.

Figure 3:
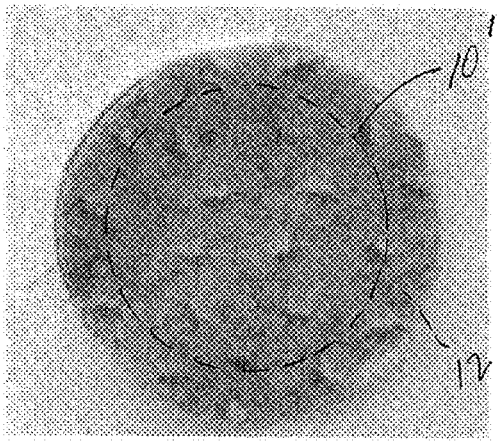
Figure 4:
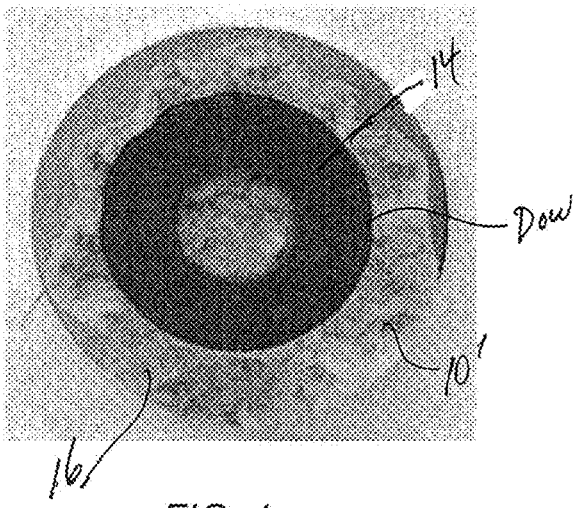
FIG. 4 shows a first template urging the fabric piece into the opening in the second template.
Figure 5:
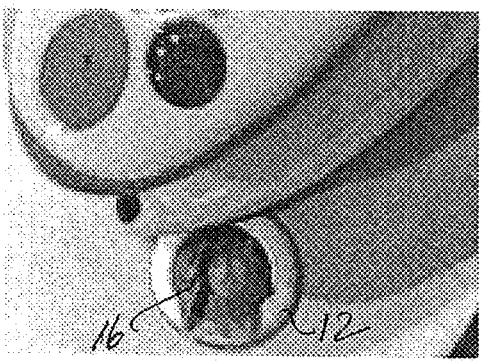
FIGS. 5 and 6 show the seam allowance being ironed atop the first template shown in FIG. 4, after the seam allowance projects through a a gap formed between the templates.
Figure 6:
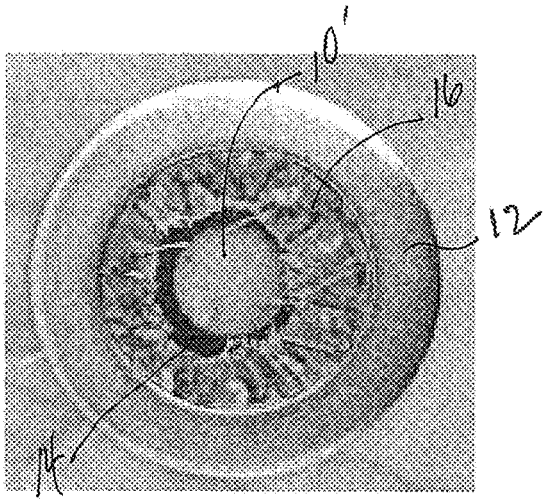
Figure 7:
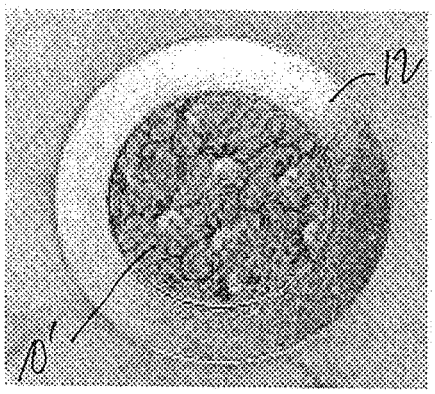
FIG. 7 shows the fabric piece as seen on the sides of the templates opposite the sides shown in FIGS. 5 and 6.

The painted fabric piece 10' is disposed face down on the second template 12 as seen in FIG. 3. The first template 14, whose outer diameter is slightly less than the inner diameter $O_{ID}$ of the second template 12, is placed over the fabric piece 10' concentric with the template 12. The first template 14 then places the fabric piece 10' in the opening in the template 12 as shown in FIG. 4, thus causing the seam allowance 16 to protrude through a determined gap between the two templates. The seam allowance 16 is then ironed atop the first template 14, toward the center of the template as shown in FIGS. 5 and 6. The two templates 12, 14 are turned over together as shown in FIG. 7, and the exposed side of the fabric piece 10' is also ironed.

Figure 8:
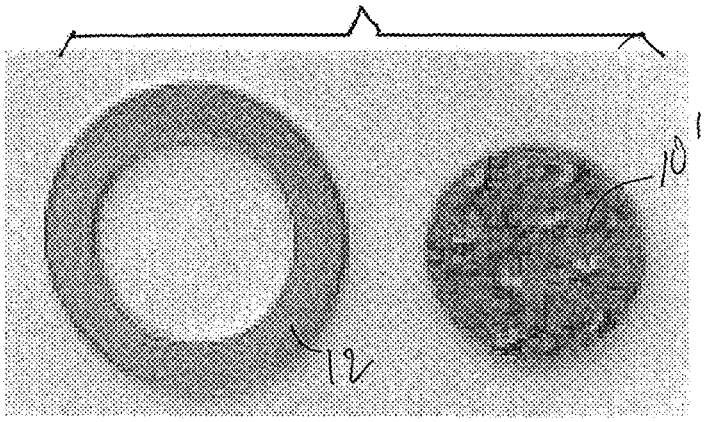
FIGS. 8 and 9 show the first template removed together with the fabric piece from the opening in the second template.
Figure 9:
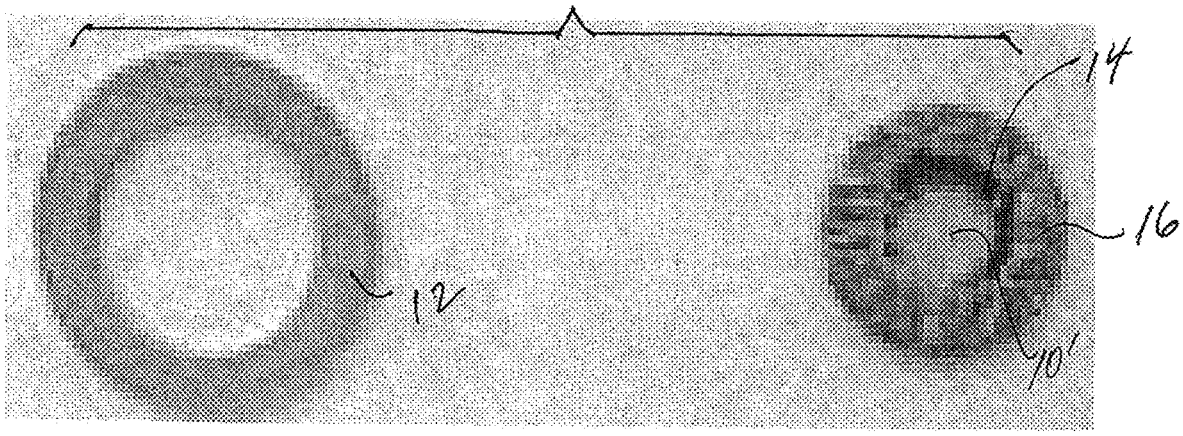
Figure 10:
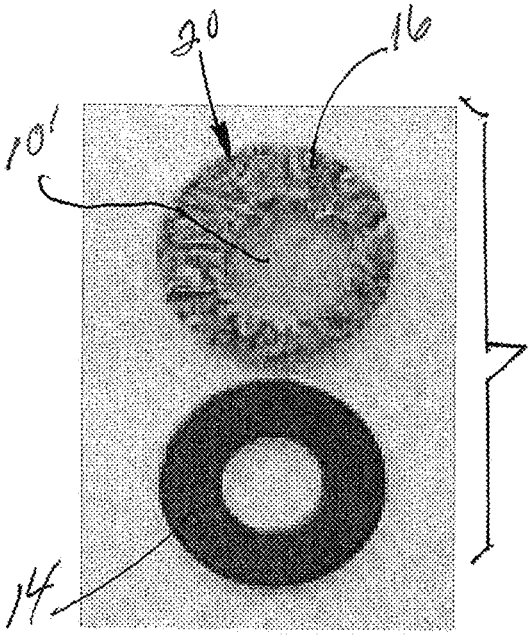
FIG. 10 shows the first template withdrawn from the ironed seam allowance to obtain a finished circle appliqué.

After the templates 12, 14 are allowed to cool, the first template 14 and overlying fabric piece 10' are urged out of the opening O in the second template 12 as seen in FIGS. 8 and 9. The first template 14 is then withdrawn from beneath the ironed seam allowance 16 to obtain a finished fabric circle appliqué 20. The appliqué 20 may be pressed again if desired. The templates 12, 14 may be formed of metal, or a suitable heat resistant non-metallic material.

According to another aspect of the invention, a set or kit for producing finished fabric appliqués of various shapes and sizes contains at least first, second, and third templates, wherein the first template can fit within a central opening in the second template with enough clearance to form a determined gap between the first and the second templates through which a seam allowance of a first fabric piece can pass (see, e.g., FIG. 4). Moreover, the second template can fit in an opening in the third template with enough clearance to form a determined gap between the second and the third template through which a seam allowance of a second fabric piece can pass. If the templates are in the form of flat rings or washers as in the present embodiment, then the outside diameters of the first templates may include, for example, ⅜ in., ½ in., ⅝ in., ¾ in., ⅞ in., 1 in., 1¼ in., and 1½ in. Note that the smallest (or the first) template in the kit does not require a central opening.

Figure 12:
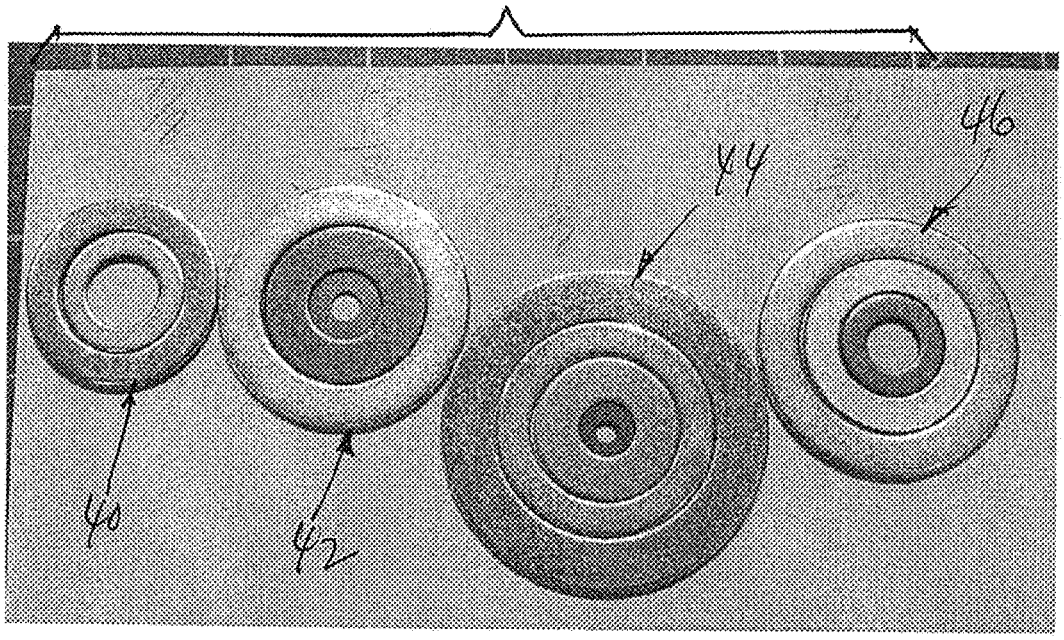
FIG. 12 shows four kits of templates each one of which can produce fabric appliqués of one, two, or three different sizes.

Also note that by providing multiples of each size template in a kit of concentric templates as in FIG. 12, a quilter can make a corresponding number of appliqués of the same size without having to wait for only one pair of templates to cool down after ironing before making the next appliqué. The templates can also be color coded so that the quilter can readily know which two templates will pair or nest within one another to make an appliqué of a desired size.

Using the inventive technique disclosed herein, the time required to produce a large number of fabric appliqués can be reduced substantially. For example, the inventor was able to construct 106 circle appliqués in under two hours. Quilters therefore need not abandon creative projects involving the application of a large number of small circles, for example, along the edge of a quilt only because of the amount of time consumed by prior techniques to do so.

Figure 11:
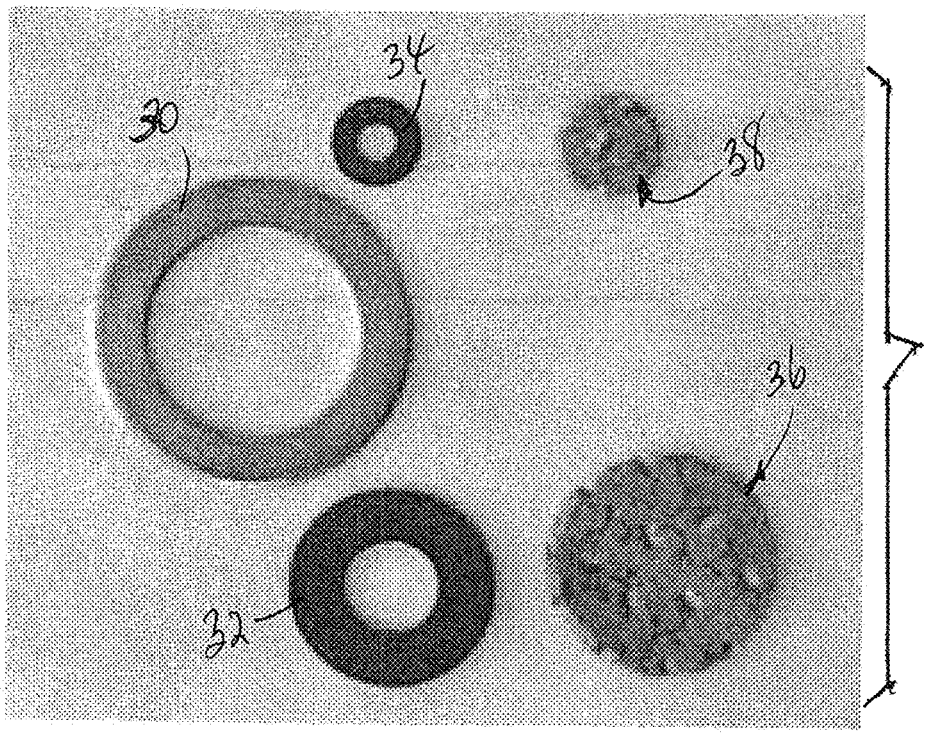
FIG. 11 shows a kit of three templates that can be used to produce fabric appliqués of two different sizes.

FIG. 11 shows a kit of three templates 30, 32, 34 that can produce finished fabric circle appliqués having an outside diameter (O.D.) of either one-half inch (appliqué 38), or 1⅛ inches (appliqué 36). In this example, template 30 has an O.D. of about 1¾ inches and an inner diameter (I.D.) of 1⅛ inches. Template 32 has an O.D. of about 1⅛ inches and an I.D. of one-half inch, and template 34 has an O.D. of about one-half inch.

To produce the appliqué 38 of one-half inch diameter, template 34 is used to place a cut fabric piece into the central opening in template 32. To produce the appliqué 36 of 1⅛ inches O.D., template 32 is used instead to place a cut fabric piece into the central opening in template 30.

FIG. 12 shows an example of four different kits 40, 42, 44, 46 containing two, three, and four concentric templates for producing finished fabric circle appliqués of various diameters, according to the invention.

The following Table lists examples of kits each of which contains four templates in the form of flat circular rings for producing fabric circle appliqués of three different diameters. Each template was formed of stainless steel 0.048+/−0.001 inch thick, and with such outside and inside diameters as to form a gap of approximately 0.0055 inch when any two templates in a given kit are nested or paired with one another to produce a finished appliqué.

| | OD | ID |
|---|---|---|
| KIT 1 | | |
| Template 1 | 0.375 | 0.125 |
| Template 2 | 0.875 | 0.386 |
| Template 3 | 1.375 | 0.886 |
| Template 4 | 1.875 | 1.386 |
| KIT 2 | | |
| Template 5 | 0.5 | 0.1875 |
| Template 6 | 1 | 0.511 |
| Template 7 | 1.5 | 1.011 |
| Template 8 | 2 | 1.511 |
| KIT 3 | | |
| Template 9 | 0.625 | 0.1875 |
| Template 10 | 1.125 | 0.636 |
| Template 11 | 1.625 | 1.136 |
| Template 12 | 2.125 | 1.636 |
| KIT 4 | | |
| Template 13 | 0.75 | 0.375 |
| Template 14 | 1.25 | 0.761 |
| Template 15 | 1.75 | 1.261 |
| Template 16 | 2.25 | 1.761 |
| KIT 5 | | |
| Template 1 | 0.375 | 0.125 |
| Template 13 | 0.75 | 0.386 |
| Template 14 | 1.25 | 0.761 |
| Template 15 | 1.75 | 1.261 |

In all cases, the outer template of any two paired templates was found to provide adequate support to hold the inner tem plate securely while the seam allowance is ironed flat atop the inner template, and allowing for maximum manipulation of relatively scant seam allowances.

The present invention is especially useful for quilters who love little circles and berries, but have been discouraged from using them on their quilts because the methods of preparation have been tedious, complicated, and require skill and dexterity. The inventive kits provide a system that overcomes deficiencies in prior methods, thus making sewing and quilting more accessible to beginners and handicapped individuals. It saves time, improves accuracy, and simplifies the preparation steps. It is more economical because it utilizes any scrap of fabric large enough to cover the opening in a desired template. And it is more enjoyable because the results are so perfect.

The kits can be hung on a ring and stored easily in a sewing box or drawer. They will not rust. Multiple templates of the same size enable more than one size appliqué to be made in succession while waiting a brief minute for the templates to cool. Because the templates fit within one another, they can be stored together in a neat column so that the loss of pieces will not be commonplace.

While the foregoing represents preferred embodiments of the present invention, it will be understood by persons skilled in the art that various changes, modifications, and additions can be made without departing from the spirit and scope of the invention.

For example, in addition to stainless steel, the tem plates may be made from any sturdy rigid material capable of withstanding the heat of a conventional iron without deforming. Further, nesting pairs of the templates may also be dimensioned and formed to produce appliqués of shapes other than circular, e.g., ovals or other geometric shapes.

Accordingly, the invention includes all such changes, modifications, and additions that are within the scope of the following claims.

I claim:

1. A method of making a turned edge fabric appliqué, comprising:

providing a first annulus template comprising a rigid structure with a perimeter that is dimensioned and formed to correspond to a desired shape of a finished appliqué of a certain size;

providing a second annulus template comprising the rigid structure with a central opening dimensioned and formed to receive the perimeter of the first annulus template with a determined gap between the first and the second annulus templates, wherein the central opening ends at an inner diameter of the second annulus template and has a size and shape corresponding to the desired shape of the finished appliqué, and where the rigid structure between the inner diameter and an outer diameter of the second annulus template has a size and shape that defines a uniform seam allowance for edges and a backside of the finished appliqué;

placing a fabric piece atop the second annulus template;

creating the uniform seam allowance, that forms the edges and the backside of the finished appliqué, by using the second annulus template to set a length of the uniform seam allowance to be between the inner diameter and the outer diameter of the second annulus template, wherein creating the uniform seam allowance comprises:

(i) trimming the fabric piece around the outer diameter of the second annulus template; and (ii) inserting the first annulus template over the fabric piece and inside the central opening of the second annulus template, wherein said inserting comprises positioning a center of the fabric piece inside the central opening of the second annulus template and under the first annulus template and the second annulus template with edges of the fabric piece extending through the determined gap above the first annulus template and the second annulus template and forming the uniform seam allowance;

ironing the edges of the fabric piece atop and against a backside of the first annulus template towards the center of the fabric piece;

removing the first annulus template with the fabric piece from the central opening in the second annulus template after said ironing; and producing the finished appliqué in the desired shape by withdrawing the first annulus template from the fabric piece.

2. The method of claim 1, including providing the first and second annulus templates in the form of flat rings.

3. The method of claim 2, wherein the flat rings are formed to be circular.

4. The method of claim 1, including forming the first and second annulus templates of stainless steel.

5. The method of claim 1, including forming the first and second annulus templates of a heat resistant non-metallic material.

6. The method of claim 1, including providing the first and second annulus templates with a thickness of approximately 0.048 inch.

7. The method of claim 1, including forming the first and second annulus templates so that the gap between a given nested pair of the annulus templates is approximately 0.0055 inch.

8. A kit for making tuned edge fabric appliqués, comprising:

a first annulus template comprising a non-sticking smooth rigid surface with a perimeter dimensioned and formed to correspond to a desired shape of a finished appliqué of a certain size;

a second annulus template comprising the non-sticking smooth rigid surface with an inner diameter formed around a central opening that is dimensioned to receive the perimeter of the first annulus template with a determined gap between the first and the second annulus templates, and with an outer diameter that is separated from the inner diameter by a common distance, wherein the non-sticking smooth rigid surface between the inner diameter and the outer diameter provides a guide with which to measure and cut a uniform seam allowance that forms edges and a backside of the finished appliqué;

wherein the first annulus template and the second annulus template are adapted to retain a center of a fabric piece under the first annulus template and the second annulus template with the uniform seam allowance of the fabric piece, cut to the common distance between the inner diameter and the outer diameter of the second annulus template, extending through the determined gap above the first annulus template and the second annulus template in response to placement of the fabric piece over the second annulus plate and insertion of the first annulus template into the central opening of the second annulus template; and wherein the non-sticking smooth rigid surface of the first annulus template facilitates removal of the first annulus template from the fabric piece after ironing the seam allowance of the fabric piece atop and against a backside of the first annulus template towards the center of the fabric piece.

9. A kit for making fabric appliqués according to claim 8, wherein the first and second annulus templates are in the form of flat rings.

10. A kit for making fabric appliqués according to claim 9, wherein the flat rings are circular.

11. A kit for making fabric appliqués according to claim 8, wherein the first and second annulus templates comprise stainless steel.

12. A kit for making fabric appliqués according to claim 8, wherein the first and second annulus templates comprise a heat resistant non-metallic material.

13. A kit for making fabric appliqués according to claim 8, wherein the first and second annulus templates are approximately 0.048 inch thick.

14. A kit for making fabric appliqués according to claim 8, wherein the first and second annulus templates are dimensioned so that the gap between a given nested pair of the annulus templates is approximately 0.0055 inch.

15. A kit for making fabric appliqués according to claim 9, wherein the outside diameters of the flat rings are selected from among ⅜ inch to 2.25 inches in determined increments.

16. A kit for making fabric appliqués according to claim 8, including a third annulus template comprising the rigid surface with a central opening dimensioned to receive the perimeter of the second annulus template with the determined gap between the second and the third annulus templates, and wherein the third annulus template has a perimeter that is greater than the perimeter of the second annulus template and that is dimensioned and formed to correspond to a finished appliqué of the desired shape at a second size larger than said first size.

17. A kit for making fabric appliqués according to claim 8, wherein the kit produces the finished appliqué in the desired shape by:

creating the uniform seam allowance, that forms the edges and the backside of the finished appliqué, in response to trimming the fabric piece around the outer diameter of the second annulus template;

placing the fabric piece atop the second annulus template;

inserting the first annulus template over the fabric piece and inside the central opening of the second annulus template with the center of the fabric piece under the first annulus template and the second annulus template and the edges of the fabric piece extending through the determined gap above the first annulus template and the second annulus template;

ironing the edges of the fabric piece atop and against the backside of the first annulus template towards the center of the fabric piece;

removing the first annulus template with the fabric piece from the central opening in the second annulus template after said ironing; and withdrawing the first annulus template from the fabric piece.

* * * * *